United States Patent [19]

Kiritani et al.

[11] Patent Number: 5,017,045

[45] Date of Patent: May 21, 1991

[54] METHOD AND APPARATUS FOR CONTROLLING ATTITUDE OF SHIELD EXCAVATOR

[75] Inventors: Yoshiharu Kiritani, Urawa; Yutaka Onishi, Yokohama; Shigeyoshi Tagata, Ogaki; Koichi Umeno, Tokyo, all of Japan

[73] Assignees: Sato Kogyo Co., Ltd., Toyama; Ishikawajima Harima Jukogyo Kabushiki Kaisha; Tokyo Keiki Co., Ltd., both of Tokyo, all of Japan

[21] Appl. No.: 557,736

[22] Filed: Jul. 26, 1990

[30] Foreign Application Priority Data

Mar. 24, 1989 [JP] Japan ..... 72199

[51] Int. Cl.[5] ..... E02D 9/06

[52] U.S. Cl. ..... 405/143; 405/141

[58] Field of Search ..... 405/138, 141, 142, 143, 405/145, 302; 91/170 M P; 299/31, 33

[56] References Cited

U.S. PATENT DOCUMENTS

| | | | |
|---|---|---|---|
| 4,412,758 | 11/1983 | Heitkamp et al. | 405/145 |
| 4,420,188 | 12/1983 | Robbins et al. | 299/31 |
| 4,432,665 | 2/1984 | Stuckmann et al. | 405/143 |

FOREIGN PATENT DOCUMENTS

| | | |
|---|---|---|
| 50-85128 | 7/1975 | Japan . |
| 111835 | 4/1989 | Japan . |
| 152560 | 11/1989 | Japan . |

*Primary Examiner*—David H. Corbin

*Attorney, Agent, or Firm*—Scrivener and Clarke

[57] ABSTRACT

Directional control of a shield excavator is automatically carried out merely by inputting a direction of rotational moment to which the excavator is directed and a magnitude of the moment.

2 Claims, 5 Drawing Sheets

METHOD AND APPARATUS FOR CONTROLLING ATTITUDE OF SHIELD EXCAVATOR

BACKGROUND OF THE INVENTION

The present invention relates to a method and an apparatus for controlling an attitude of a shield excavator to excavate a curved tunnel or to change the direction of advancing the excavator.

A shield excavator has a plurality of thrust jacks in a circumferential direction of a shield frame for advancing the excavator. Advancement of the excavator is carried out by extending piston rods of the jacks through supply of pressurized working oil into the jacks with their rear ends being securely supported by segments.

In order to curvedly advance the excavator, some of the jacks are supplied with enough pressurized working oil to extend their piston rods while the remaining jacks are supplied with no working oil or supplied with working oil pressurized to the extent that no thrust force is imparted to the excavator. That is, as to the remaining jacks, no-load following operation is carried out such that their piston rods extend merely to follow the advancement of the excavator.

FIG. 1 shows a hydraulic circuit of a conventional automatic directional control system for use with the above-mentioned conventional shield excavator. A hydraulic pump 2, which pumps oil from a storage tank 1 and pressurizes the same, is connected at its discharge port to an end of a pipeline 3 the other end of which in turn is connected to a main selector valve 4. The valve 4 is connected through a return pipeline 5 to the tank 1 so as to return the working oil.

The valve 4 is further connected with two pipelines 6 and 11. The pipeline 6 is branched into pipelines 7*a* and 7*b* which in turn are respectively communicated with head-side oil chambers 22*a* and 22*b* of thrust jacks 10*a* and 10*b* through jack load pressure selector valves 8*a* and 8*b* and pipelines 9*a* and 9*b*. The pipeline 11 is branched into two pipelines 12*a* and 12*b* which are respectively communicated with rod-side oil chambers 23*a* and 23*b* of the jacks 10*a* and 10*b*.

A no-load following valve block 13 comprises a pressure reducing valve 15 for reducing the pressure of the working oil from the selector valve 14, a pipeline 16 for passage of the working oil from the reducing valve 15 and check valves 17*a* and 17*b* for preventing the working oil from returning to the valve 15. The pipeline 6 is connected to the selector valve 14 through a pipeline 18. The check valves 17*a* and 17*b* are connected to the pipelines 9*a* and 9*b* through pipelines 19*a* and 19*b*.

The pipelines 19*a* and 19*b* are connected to the tank 1 through a pipeline 20 with check valves 21*a* and 21*b*. Reference numerals 24 and 25 denote safety valves. It is to be understood that many thrust jacks 10 are disposed side by side in practice though only two jacks 10*a* and 10*b* are shown in FIG. 1. Set pressures $P_1$, $P_2$ and $P_3$ of the safety valves 24 and 25 and the pressure reducing valve 15, respectively, are adjusted to satisfy the following condition:

$$P_1 \approx P_2 >> P_3$$

FIG. 2 illustrates a typical operation control board 26 of conventional shield excavators. The board 26 comprises a plurality of equiangularly spaced jack selection switches 27 (12 switches are shown in FIG. 2) which are disposed in the form of ring correspondingly to the thrust jacks, rotational moment directional pilot plates 28 (24 pilot plates are shown in FIG. 2) disposed in positions correspond to the switches 27 and correspond to midways between the switches 27, and a jack operation unit 32 comprising push, pull and stop switches 29, 30 and 31. The board 26 further has a load pressure indicator 33, a left jack stroke meter 34, a right jack stroke meter 35 and a pitching indicator 36 (or inclinometer in the axial direction).

When the selection switch 27 is pushed, the switch 27 lights on and correspondingly a command signal is outputted to a valve unit 37 so as to change over the selector valves 8*a* and 8*b* of the corresponding jacks 10*a* and 10*b* to the load pressure side. When the push switch 29 is pushed, the switch 29 lights on and correspondingly a command signal is outputted to the valve unit 37 so as to change over the main selector valve 4 to the push side, whereby the piston rods of the selector valves 8*a* and 8*b* having been changed over to the load pressure side are extended in unison for excavation. When the switches 27 and 29 are pushed again, they light off and the respective selector valves 8*a*, 8*b* and 4 are changed over to neutral positions (or closing sides).

When the shield excavator is to be advanced straightforwardly, all the jack selection switches 27 are pushed to light on so that all the selector valves 8*a* and 8*b* are changed over to the load pressure sides. Then the push switch is pushed to light on so that the main selector valve 4 is changed over to the push side. As a result, all the jacks 10*a* and 10*b* are concurrently extended to straightforwardly advance the excavator for excavation.

When excavation of a curved tunnel or correction in direction of advancing the shield excavator is required, an operator turns off some of the jack selection switches 27, which correspond to the jacks in the direction of orienting the excavator. As a result, the corresponding selector valves 8*a* and 8*b* are changed over to their neutral positions so that the corresponding jacks 10*a* and 10*b* are de-energized and consequently a rotational moment is imparted to the excavator.

Whether a desired attitude is attained or not is checked by the left and right jack stroke meters 34 and 45 as to the left and right directions and by the pitching meter 36 as to the upward and downward directions. When the excavator is inclined to much or too less in the upward or downward direction and/or is directed too much or too less in the right or left direction, such deviation is compensated by accordingly increasing or decreasing the number of jacks to be energized.

Which jacks are to be energized is determined as follows. From a total thrust required to advance the excavator, a required minimum thrust jack number (in general more than half of all the thrust jacks) is determined. Thrust jacks to be energized are selected in a jack pattern or arrangement such that the required rotational moment is obtained with the thrust jacks being greater in number than the minimum number and as many as possible and being in dispersed pattern so as not to burden locally concentrated load to the segments.

According to such prior art system, the number of the jacks to be energized is determined depending upon a required total thrust; and the jacks to be energized are experientially selected in view of combined vertical and horizontal moments. In order to minimize meandering movements of the excavator and to attain a high degree of accuracy of a finished tunnel, any positional error and attitudinal deviation of the shield excavator must be compensated as soon as possible. Therefore, the rotational moment must be changed little by little, which requires random jack selection. The jack selection is conventionally effected by an operator's own judgment so that it is much difficult and requires a skilled operator.

In a further conventional system, gyroscopic or laser-type automatic position and attitude sensors are equipped. In response to signals from the sensors, thrust jacks are controlled to carry out automatic direction control of a shield excavator. Also in this case, jack patterns or combinations to be selected are so many that algorithm of selecting jacks to be energized is too complicated.

In view of the above, a primary object of the present invention is to provide a method and apparatus for controlling the attitude of a shield excavator which can simplify and automate the control of the attitude of the shield excavator and which can be operated by an ordinary operator not by a skilled operator because operation steps which requires the operator's judgment are minimized.

BRIEF SUMMARY OF THE INVENTION

The present invention is directed to a method for controlling an attitude of a shield excavator which comprises dividing a plurality of shield jacks in a shield excavator into two groups of mutually adjacent shield jacks, one of said group being operated by a load pressure while the other group is operated by a controlled pressure, position of said division of the jacks into two groups being set depending upon a direction of rotational moment to which the shield excavator is desired to be directed, a magnitude of said controlled pressure being set depending upon a desired magnitude of the rotational moment. The present invention is further directed to an apparatus for controlling an attitude of a shield excavator comprising jack load pressure selector valves arranged for a plurality of shield jacks, a main selector valve for feeding a liquid from a hydraulic pump through rod-side oil chambers of said jacks or said jack load pressure selector valves to head-side oil chambers of the jacks, an electro-hydraulic pressure reducing valve for supply the liquid from said hydraulic pump, controlled pressure selector valves each arranged in respective pipelines branched for feeding the liquid from the electro-hydraulic pressure reducing valve into head-side oil chambers of said jacks, each of said controlled pressure selector valves being interlocked with the associated load pressure selector valve such that when one is opened, the other is closed, an input device for commanding a direction of rotational moment to which the shield excavator is desired to be oriented, an arithmetic controller for controlling change-over of the interlocked load-pressure and controlled-pressure selector valves and a variable setting device for setting the controlled pressure of said electro-hydraulic pressure reducing valve depending upon a desired magnitude of the rotational moment.

Therefore, according to the present invention, a direction of orienting a shield excavator is commanded by an input device so that depending upon the inputted direction, jack load pressure selector valves and controlled pressure selector valves are automatically selectedly changed over so as to dividing thrust jacks into groups of load pressure side and of controlled pressure side. Further, a magnitude of a required rotational moment is commanded by a variable setting device such as potentiometer so that said controlled pressure is automatically set.

BRIEF DESCRIPTION OF THE DRAWINGS

Similar reference numerals are used to designate similar parts throughout the figures.

DETAILED DESCRIPTION OF THE PREFERRED EMBODIMENT

Figure 1:
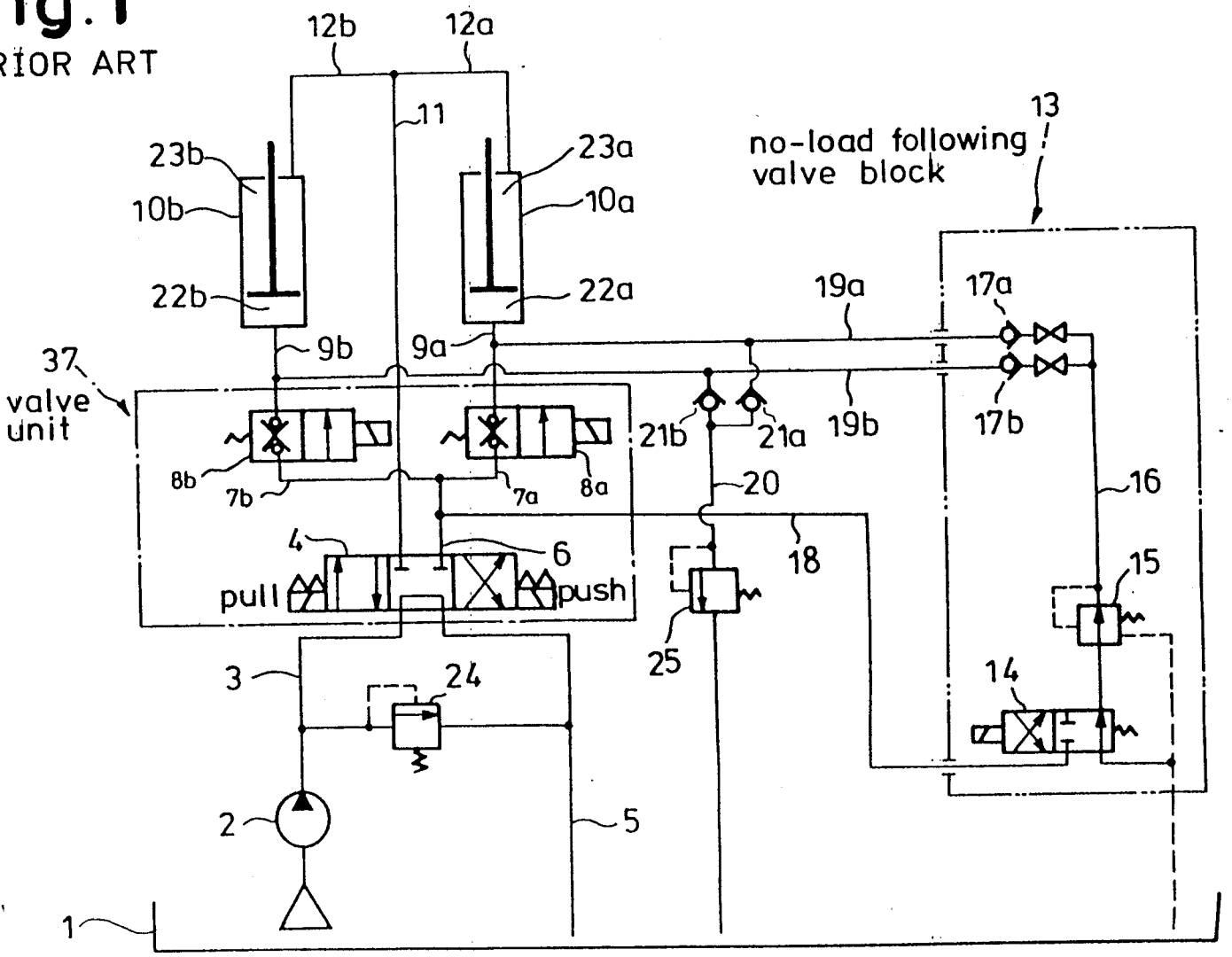
Fig. 1 PRIOR ART
FIG. 1 is a hydraulic circuit diagram for a conventional shield excavator.
Figure 2:
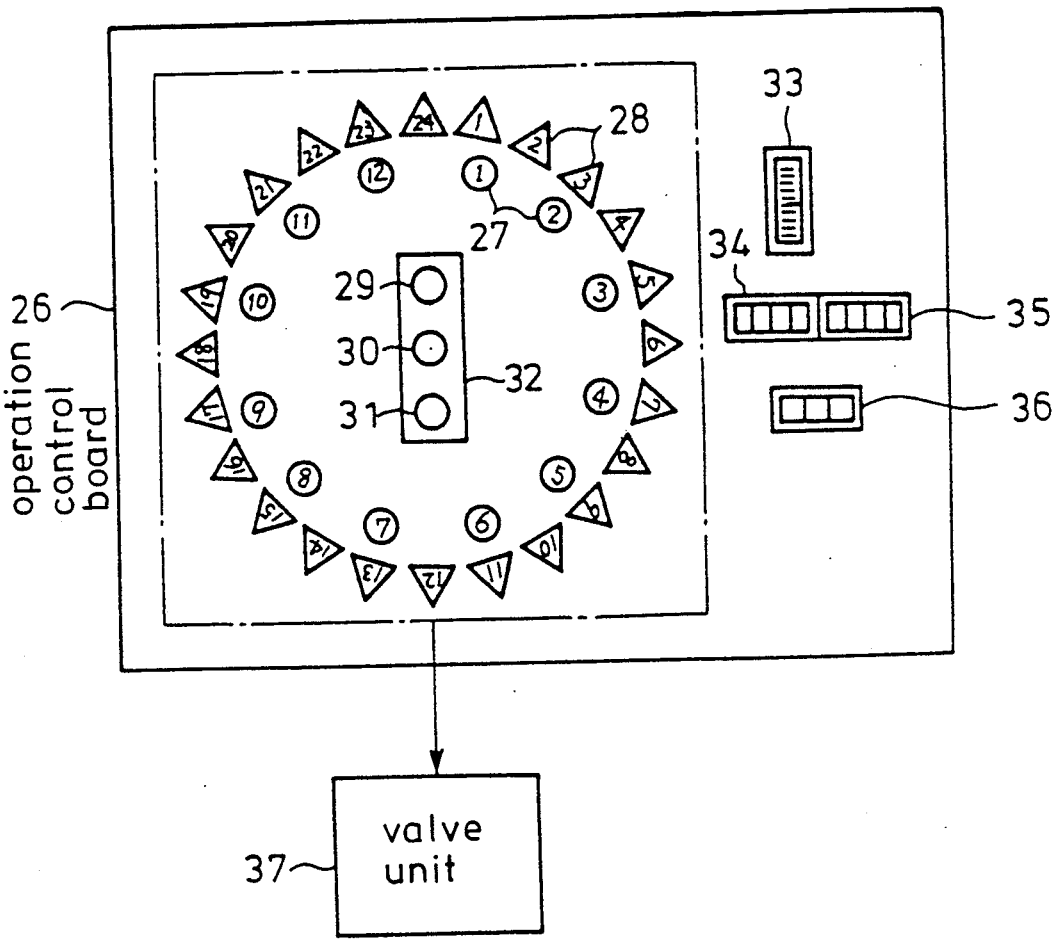
Fig. 2 PRIOR ART
FIG. 2 is a block diagram of an operation control board thereof.
Figure 3:
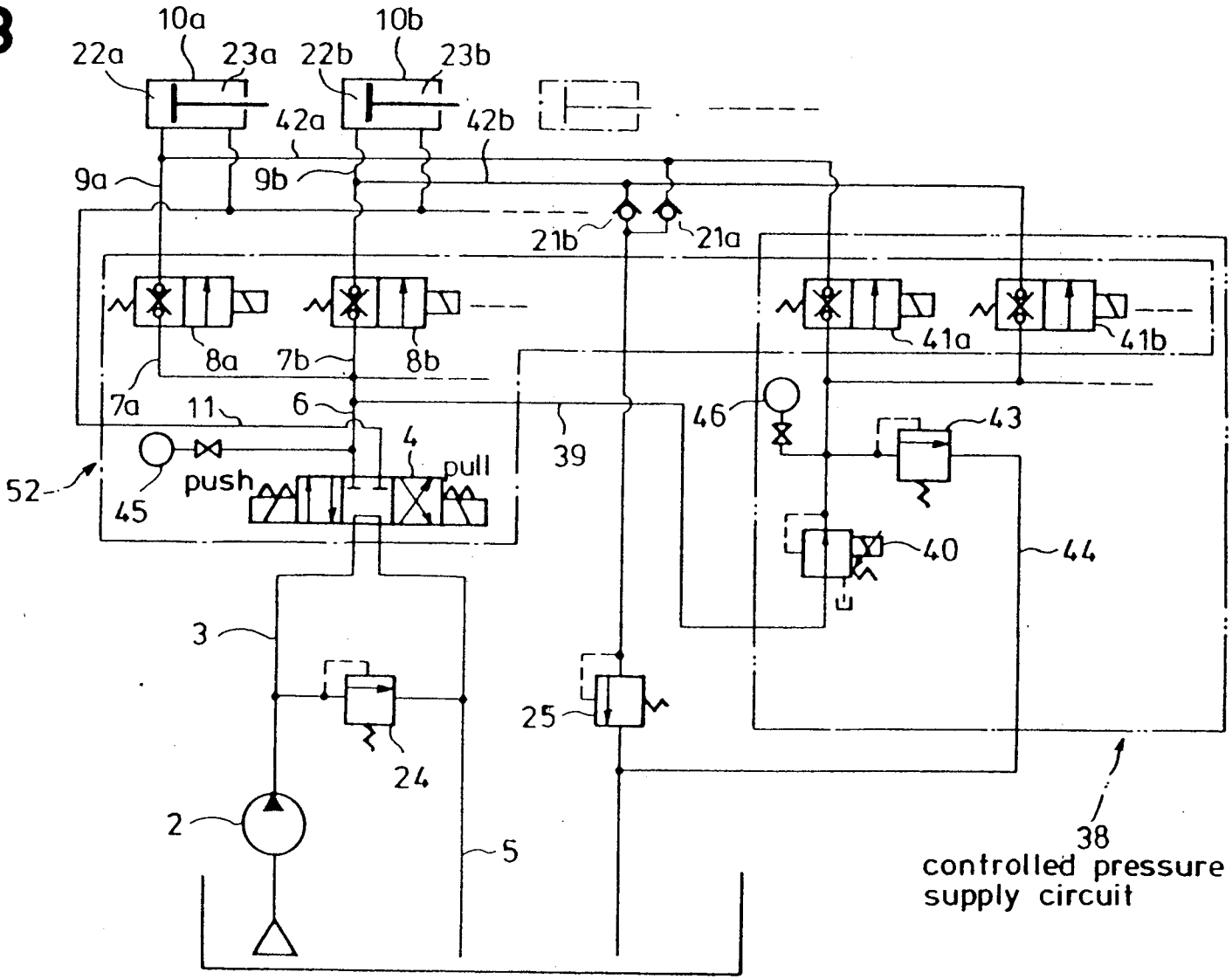
FIG. 3 is a hydraulic circuit diagram of a preferred embodiment of the present invention.

FIG. 3 shows a preferred embodiment of the present invention in which a controlled pressure supply circuit 38 is provided instead of the conventional no-load following valve block 13 shown in FIG. 1.

The pipeline 6, which supplies the working oil from the tank 1 through the hydraulic pump 2, the pipeline 3, the main selector valve 4, the pipelines 6, 7*a* and 7*b*, the selector valves 8*a* and 8*b* and the pipelines 9*a* and 9*b* to the head-side oil chambers 22*a* and 22*b* of the thrust jacks 10*a* and 10*b*, is connected through a steplessly pressure-controllable electro-hydraulic pressure reducing valve 40 to controlled pressure selector valves 41*a* and 41*b*. Pipelines 42*a* and 42*b* from the valves 41*a* and 41*b* are connected to the head-side pipelines 9*a* and 9*b* of the corresponding thrust jacks 10*a* and 10*b*.

The jack load pressure selector valves 8*a* and 8*b* and the controlled pressure selector valves 41*a* and 41*b* are paired in conjunction with the jacks 10*a* and 10*b* and are so interlocked that when one is opened, the other is closed.

Between the discharge side of the valve 40 and the pipeline 5 is disposed a pipeline 44 with a safety valve 43. Set pressure of the safety valve 43 which is higher than that of the pressure reducing valve 40 is made equal to the set pressure of the safety valve 24 or is made correlated with the set pressure of the valve 40 by use of an electro-hydraulic relief valve. Reference numeral 45 represents a load pressure sensor; and 46, a controlled pressure sensor.

Figure 4:
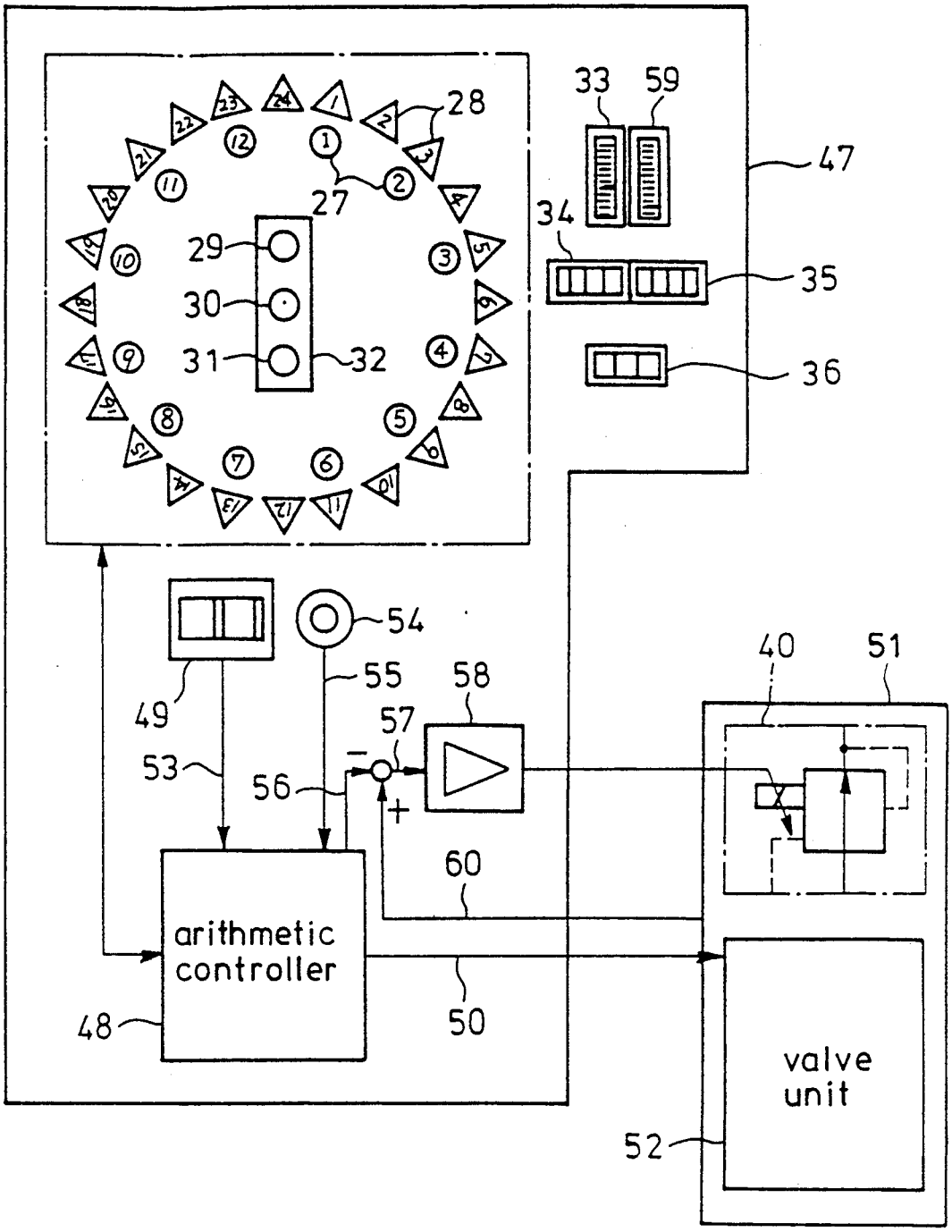
FIG. 4 is a block diagram of an operation control board thereof.

FIG. 4 illustrates an operation control board 47 used in the present invention. An input device 49 serves to digitally command a desired direction of rotational moment to an arithmetic controller 48 incorporated in the board 47. In response to an output 50 from the controller 48, the jack load pressure selector valves 8*a* and 8*b*, the controlled pressure selector valves 41*a* and 41*b* and the main selector valve 4 are switched.

In the arithmetic controller 48, the number of thrust jacks to be energized is determined in response to a signal 53 commanding the direction of the rotational moment from the input device 49 or in response to a separate set signal representative of the number of thrust jacks to be energized. A signal 55 from a variable setting device or potentiometer 54 for setting a magnitude of the rotational moment is adjusted depending upon the determined number of the thrust jacks to be energized. A signal 57 consisting of thus adjusted signal 56 added with a load pressure feedback signal 60 is inputted into a control amplifier 58 an output of which in turn is applied to the pressure reducing valve 40.

Reference numeral 59 represents a controlled pressure indicator for indicating the controlled pressure detected by the sensor 46. The controlled pressure indicator 59 is disposed adjacent to the load pressure indicator 33 which indicates the load pressure detected by the sensor 45.

In advancement of the shield excavator, No. of the rotational moment directional pilot plate 28 to which direction the excavator is to be directed or oriented is digitally inputted to the input device 49.

Then, in response to said desired direction of the rotational moment, the load pressure selector valves 8*a* and 8*b* and the controlled pressure selector valves 41*a* and 41*b* are switched over to communicate with the corresponding thrust jacks 10*a* and 10*b*. A magnitude of the desired rotational moment is set by the variable setting device or potentiometer 54 so that a required controlled pressure of the electro-hydraulic pressure reducing valve 40 is set, whereby the rotational moment with the desired direction and with the desired magnitude is obtained.

In order to amend the direction and magnitude of the rotational moment, any variation in attitude of the shield excavator is monitored based on displays of the right and left jack stroke meters 34 and 35 and the pitching meter 36 and the magnitude of the rotational moment obtained from the difference in display between the load pressure indicator 33 and the controlled pressure indicator 59 and the number of the energized jacks and accordingly the input device 49 and the potentiometer 54 are adjusted to attain a desired attitude.

Figure 5A:
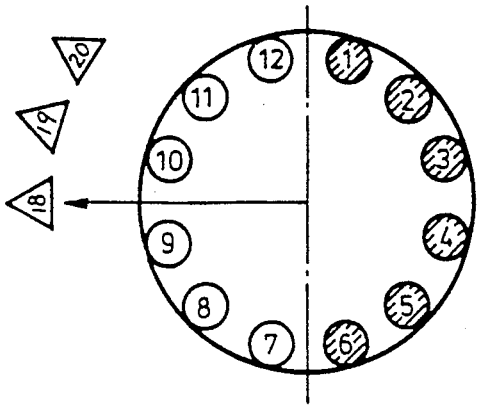
FIGS. 5(A), 5(B) and 5(C) illustrate examples of dividing thrust jacks into groups.

FIG. 5(A) illustrates excavation of a curved tunnel with the total of 12 thrust jacks. The jacks ①-⑥ are assigned on the load side while the remaining six jacks ⑦-⑫ are assigned on the controlled pressure side. The direction of rotational moment is oriented to ⚠18.

Figure 5B:
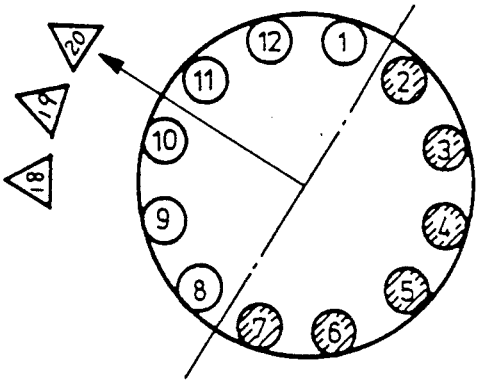

FIG. 5(B) illustrated change of the direction of the rotational moment from ⚠18 to ⚠20. In this case, the jack ① is energized by the controlled pressure while ⑦ is in the load operation.

Figure 5C:
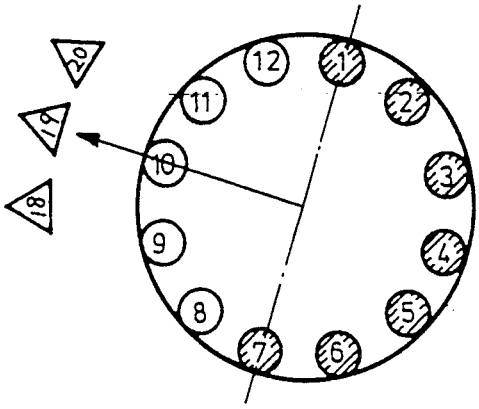

When the direction of the rotational moment oriented to ⚠19 is selected as shown in FIG. 5(C), as compared with the state shown in FIG. 5(A), one jack ⑦ is added to the load pressure operation. In this case, in order to prevent any variations in the magnitude of the rotational moment, the electro-hydraulic pressure reducing valve 40 is adjusted due to calculation by the arithmetic controller 48.

By the above-described operation, the direction of the rotational moment can be set and adjusted by a half of a pitch of the thrust jacks 10*a* and 10*b*.

It is to be understood that the method and apparatus for controlling the attitude of the shield excavator according to the present invention is not limited to the above-described embodiment and that various modifications may be effected without leaving the true spirit of the present invention.

As described above, according to the method and apparatus for controlling the attitude of the shield excavator of the present invention, the following excellent effects can be attained.

(i) The attitude of the shield excavator can be controlled only by setting the direction and magnitude of the rotational moment, without a skilled operator.

(ii) The thrust jacks are divided into two groups of mutually adjacent thrust jacks, one of the groups being controlled by the load pressure while the other group is controlled by the controlled pressure. As a result, the control of the attitude of the shield excavator is simplified and automatic control is readily realized.

What is claimed is:

1. A method for controlling an attitude of a shield excavator which comprises dividing a plurality of thrust jacks in a shield excavator into two groups of mutually adjacent thrust jacks, one of said group being operated by a load pressure while the other group is operated by a controlled pressure, position of said division of the jacks into two groups being set depending upon a direction or rotational moment to which the shield excavator is desired to be directed, a magnitude of said controlled pressure being set depending upon a desired magnitude of the rotational moment.

2. An apparatus for controlling an attitude of a shield excavator comprising jack load pressure selector valves arranged for a plurality of thrust jacks, a main selector valve adapted to feed a liquid from a hydraulic pump through rod-side oil chambers of said jacks or said jack load pressure selector valves to head-side oil chambers of the jacks, an electro-hydraulic pressure reducing valve adapted to supply the liquid from said hydraulic pump, controlled pressure selector valves each arranged in respective pipelines branched for feeding the liquid from the electro-hydraulic pressure reducing valve into head-side oil chambers of said jacks, each of said controlled pressure selector valves being interlocked with the associated load pressure selector valve such that when one is opened, the other is closed, an input device for commanding a direction of rotational moment to which the shield excavator is desired to be oriented, an arithmetic controller for controlling change-over of said interlocked load-pressure and controlled-pressure selector valves depending upon a command signal from said input device and a variable setting device for setting a controlled pressure of said electro-hydraulic pressure reducing valve depending upon a desired magnitude of the rotational moment.

* * * * *